US008894556B2

(12) United States Patent
Webb

(10) Patent No.: US 8,894,556 B2
(45) Date of Patent: Nov. 25, 2014

(54) MULTI-FUNCTION HANDLE FOR WEIGHT TRAINING MACHINE

(75) Inventor: Gregory M. Webb, Independence, VA (US)

(73) Assignee: Med-Fit Systems, Inc., Independence, VA (US)

( * ) Notice: Subject to any disclaimer, the term of this patent is extended or adjusted under 35 U.S.C. 154(b) by 0 days.

(21) Appl. No.: 13/040,656

(22) Filed: Mar. 4, 2011

(65) Prior Publication Data

US 2012/0225760 A1 Sep. 6, 2012

(51) Int. Cl.

| | |
|---|---|
| ***A63B 71/00*** | (2006.01) |
| ***A63B 21/02*** | (2006.01) |
| ***A63B 21/072*** | (2006.01) |
| ***A63B 21/075*** | (2006.01) |
| ***A63B 21/078*** | (2006.01) |
| ***A63B 21/062*** | (2006.01) |
| ***A63B 21/00*** | (2006.01) |
| ***A63B 23/12*** | (2006.01) |

(52) U.S. Cl.

CPC ..... *A63B 21/1469* (2013.01); *A63B 21/072* (2013.01); *A63B 21/075* (2013.01); *A63B 21/078* (2013.01); *A63B 21/062* (2013.01); *A63B 23/12* (2013.01)

USPC ..... 482/139; 482/126

(58) Field of Classification Search

USPC ..... 482/139, 126, 135, 138

See application file for complete search history.

(56) References Cited

U.S. PATENT DOCUMENTS

| | | | | |
|---|---|---|---|---|
| 4,661,077 | A * | 4/1987 | Griffith et al. | 441/84 |
| 4,756,527 | A * | 7/1988 | Ledbetter | 482/139 |
| 5,090,691 | A * | 2/1992 | Pollock | 482/139 |
| 5,514,057 | A * | 5/1996 | Ciolino | 482/111 |
| 6,216,319 | B1 * | 4/2001 | Elkins | 24/3.2 |
| 7,484,273 | B1 * | 2/2009 | Dupree et al. | 24/3.13 |
| 7,662,073 | B1 * | 2/2010 | Baldwin | 482/92 |
| 7,892,157 | B2 * | 2/2011 | Arnett | 482/131 |
| 8,007,413 | B1 * | 8/2011 | Wu | 482/91 |
| 8,152,704 | B2 * | 4/2012 | Brice et al. | 482/129 |
| 2003/0017918 | A1 * | 1/2003 | Webb et al. | 482/94 |
| 2009/0075794 | A1 * | 3/2009 | Hetrick | 482/139 |
| 2011/0245050 | A1 * | 10/2011 | Emick | 482/139 |

* cited by examiner

*Primary Examiner* — Loan H Thanh
*Assistant Examiner* — Shila Jalalzadeh Abyan
(74) *Attorney, Agent, or Firm* — Myers Bigel Sibley & Sajovec, P.A.

(57) ABSTRACT

A multi-functional handle assembly for an exercise machine includes: a strap arranged in a Figure-8 configuration to form a near loop and a far loop extending in generally opposite directions from a crossing point in the strap; a handle having a cavity formed therethrough, wherein the near loop extends to the near side of the handle and the far loop extends from the far side of the handle, the crossing point of the strap positioned in the cavity; a cushioning cuff attached to the far loop; a bearing member having a slot, wherein portions of the near loop are threaded through the slot, such that the bearing member is slidable relative to the portions of the near loop; and means for attaching the handle assembly to the exercise machine, the means for attaching the handle assembly being attached to the near loop. The handle can be drawn between the bearing member and the cushioning cuff, the strap sliding within the handle, such that the near loop and the far loop change in size with sliding of the handle. Movement of the handle and the bearing member can enable the handle assembly to be used with upper body, triceps extension, and leg/hip exercises.

18 Claims, 8 Drawing Sheets

MULTI-FUNCTION HANDLE FOR WEIGHT TRAINING MACHINE

FIELD OF THE INVENTION

The present invention relates generally to exercise equipment, and relates more particularly to weight training equipment.

BACKGROUND OF THE INVENTION

Exercise devices, and in particular weight training machines, typically include a mechanical member that the user repeatedly moves along a prescribed path for exercise. Conventionally, movement of the mechanical member is resisted in some fashion (often by weights) to render the movement more difficult and thereby intensify the exercise. The movement of the mechanical member determines what muscle or muscle groups are to be involved in the exercise.

One exercise device that has become prevalent in recent years is the multi-functional exercise machine, which enables the user to position components of the machine in different locations in order to perform different exercises. These machines have proven to be particularly popular for serious exercisers and for exercisers that work with personal trainers, as the machines can be adjusted to provide the exerciser with numerous exercises that work different muscle groups. One example of such a machine is the FREEDOM TRAINER™, available from Med-Fit Systems, makers of Nautilus Commercial Exercise Equipment, Independence, Va. This machine includes two arms that extend from a frame. The arms are able to pivot approximately 150 degrees about horizontal axes to different "locked" positions (separated by about 15 degree increments) that raise and lower the free ends of the arms. The arms are also pivotable about vertical axes to different positions (again, separated by about 15 degrees) that bring the free ends of the arms closer together or separate them. Cables extend through the arms and to a weight stack that resides within the frame. Handles are attached to the cables at the ends of the arms. To exercise, the exerciser selects positions for each arm (which may differ), then positions himself in a particular position, posture and orientation and begins pulling on one or both of the handles with his hands or feet. The handles separate from the free ends of the arms, with resistance being provided by the weights through the cables.

One of the reasons machines like the FREEDOM TRAINER™ machine are popular is that the exerciser can perform a large number of exercises with the same machine simply by varying his position, posture and/or orientation and by varying the positions of the arms. For example, for any position of the arms, during exercise the exerciser may choose to face toward or away from the frame, or may stand sideways relative to the frame; any of these positions would exercise different muscles or portions thereof. Similarly, the exerciser may stand, sit, kneel, or lie on the ground (prone, supine, or on his side), or lie on a bench and achieve different results. The exerciser may also choose to work with one or both hands, or with one or both feet, engaging the handles. Similar variability in exercise can be achieved with alternative positions of the exercise arms.

One issue that can arise with multi-function machines is the handle, strap or other component that the exerciser grasps or otherwise contacts during exercise. For example, one style of handle may have a grip that is easily grasped by the hand for an arm or chest exercise, but that would be uncomfortable or unwieldy for use on the foot or ankle. Thus, often a gym or exercise area will include multiple handles that can be attached/detached for different exercises. Of course, the use of multiple handles can render the exercise session more time-consuming due to the need to change out the handles between exercises, and there is an addition inconvenience in having to store and keep track of multiple handles.

One multifunctional handle is the dual function handle, available from Med-Fit Systems, which is intended for use for both upper body and leg/hip exercises. The handle includes a strap that is formed into a "Figure 8" configuration to form two loops, with the crossed portions of the strap (i.e., the intersection of the "Figure 8") being threaded inside a relatively rigid cylindrical sleeve. One loop of the strap is threaded into a reinforcing/cushioning cuff. The opposite is includes a hook or similar structure to attach to a cable or the like of an exercise machine. This arrangement enables the rigid sleeve to slide relative to either end of the strap, such that either loop can be enlarged as the other loop shrinks. For a leg/hip exercise, the sleeve is slipped toward the end of the strap nearest the connection to the exercise machine, and the handle can be fitted around the exerciser's ankle, with the reinforcing/cushioning cuff providing a somewhat cushioned contact surface for the ankle as the exerciser's leg draws the handle away from the machine. This handle configuration is suitable for a number of leg/hip exercises, such as leg extension, leg curl, hip extension, hip flexion, hip adduction, and hip abduction. For an upper body exercise, the rigid sleeve is slipped to the end of the strap nearest the reinforcing/cushioning cuff, and the exerciser grasps the rigid sleeve with the palm of his hand to draw the handle away from the machine. This handle configuration is suitable for upper body exercises in which the exerciser grasps the handle with the palm of this hand, such as biceps curl, lat pulldown, seated row, chest press, and chest crossover exercises.

It may be desirable to provide additional function to multi-function handles such as that described above.

SUMMARY OF THE INVENTION

As a first aspect, embodiments of the invention are directed to a multi-functional handle assembly for an exercise machine. The handle assembly comprises: a strap arranged in a Figure-8 configuration to form a near loop and a far loop extending in generally opposite directions from a crossing point in the strap; a handle having a cavity formed therethrough, wherein the near loop extends to the near side of the handle and the far loop extends from the far side of the handle, the crossing point of the strap positioned in the cavity; a cushioning cuff attached to the far loop; a bearing member having a slot, wherein portions of the near loop are threaded through the slot, such that the bearing member is slidable relative to the portions of the near loop; and means for attaching the handle assembly to the exercise machine, the means for attaching the handle assembly being attached to the near loop. The handle can be drawn between the bearing member and the cushioning cuff, the strap sliding within the handle, such that the near loop and the far loop change in size with sliding of the handle. Movement of the handle and the bearing member can enable the handle assembly to be used with upper body, triceps extension, and leg/hip exercises.

As a second aspect, embodiments of the invention are directed to an exercise machine, comprising: a frame; resistance means associated with the frame; a first movable member attached to the frame; a first cable attached to the resistance means and associated with the movable member; and a handle assembly attached to one end of the cable. The handle assembly comprises: a strap arranged in a Figure-8 configuration to form a near loop and a far loop extending in generally opposite directions from a crossing point in the strap; a handle having a cavity formed therethrough, wherein the near loop extends to the near side of the handle and the far loop extends from the far side of the handle, the crossing point of the strap positioned in the cavity; a cushioning cuff attached to the far loop; a bearing member having a slot, wherein portions of the near loop are threaded through the slot, such that the bearing member is slidable relative to the portions of the near loop; and means for attaching the handle assembly to the first cable, the means for attaching the handle assembly being attached to the near loop. The handle can be drawn between the bearing member and the cushioning cuff, the strap sliding within the handle, such that the near loop and the far loop change in size with sliding of the handle.

As a third aspect, embodiments of the invention are directed to A method of exercising with an exercise machine. As a first step, the method comprises (a) providing an exercise machine having: a frame; resistance means associated with the frame; a first movable member attached to the frame; a first cable attached to the resistance means and associated with the movable member; and a handle assembly attached to one end of the cable, the handle assembly comprising: a strap arranged in a Figure-8 configuration to form a near loop and a far loop extending in generally opposite directions from a crossing point in the strap; a handle having a cavity formed therethrough, wherein the near loop extends to the near side of the handle and the far loop extends from the far side of the handle, the crossing point of the strap positioned in the cavity; a cushioning cuff attached to the far loop; a bearing member having a slot, wherein portions of the near loop are threaded through the slot, such that the bearing member is slidable relative to the portions of the near loop; and means for attaching the handle assembly to the first cable, the means for attaching the handle assembly being attached to the near loop; The method continues with (b) engaging the handle assembly with a portion of an exerciser's body, and (c) drawing the handle assembly away from the frame.

DETAILED DESCRIPTION OF EMBODIMENTS OF THE INVENTION

Figure 1:
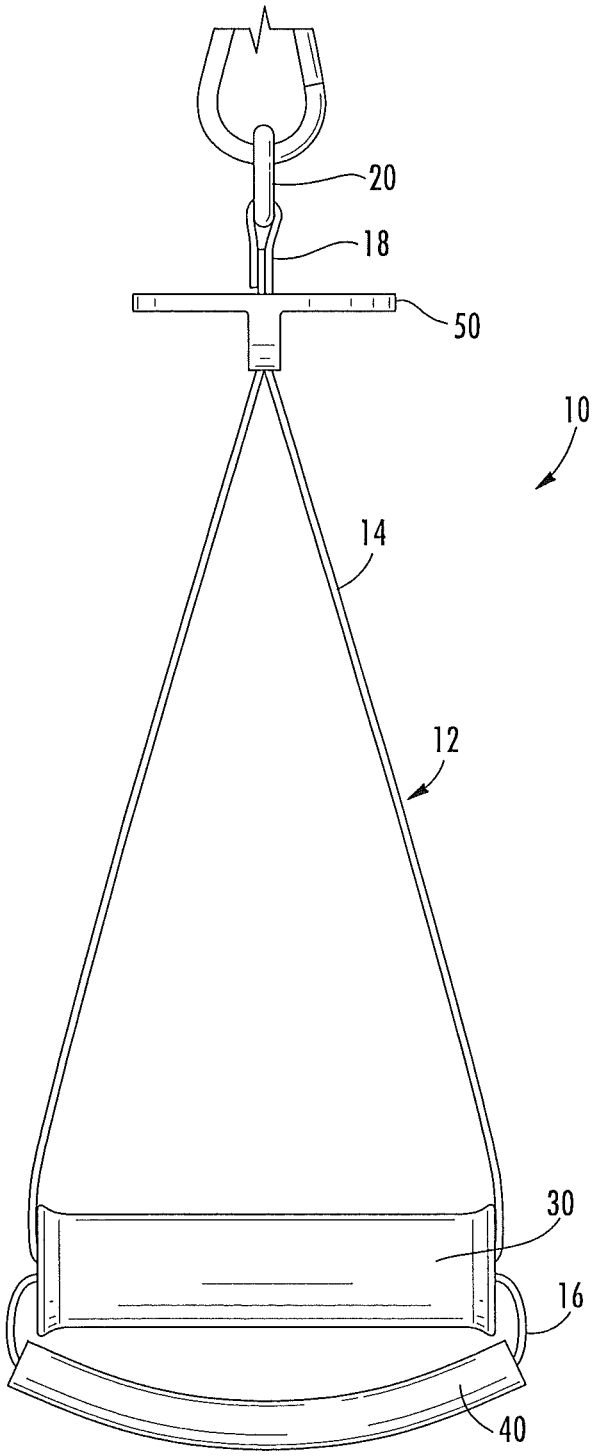
FIG. 1 is a front view of a handle assembly according to embodiments of the present invention, with the handle positioned adjacent the cushioning cuff and the bearing member positioned adjacent the ring loop.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Turning now to the figures, a multi-functional handle assembly for an exercise machine, designated broadly at 10, is shown in FIG. 1. The handle assembly 10 includes a strap 12, a handle 30, a cushioning cuff 40, and a bearing member 50. These components are described in greater detail below.

Figure 2:
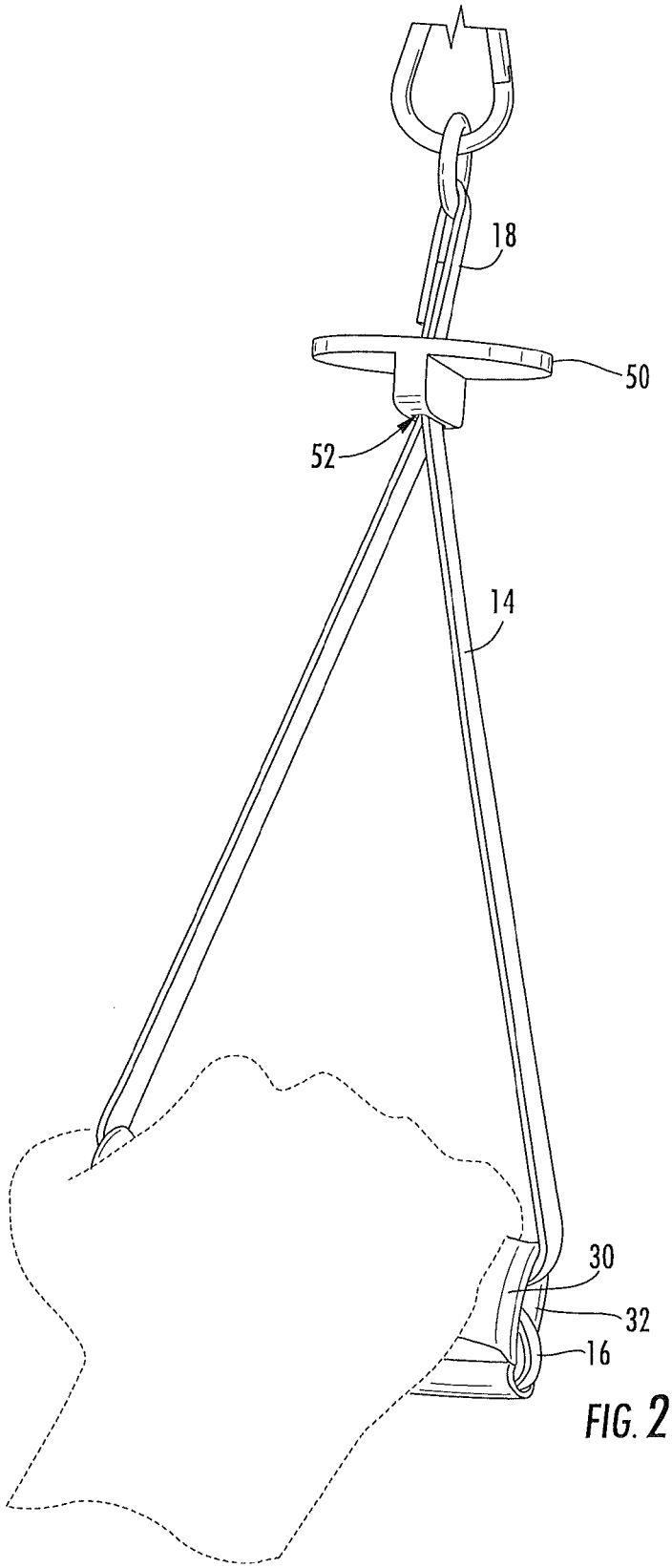
FIG. 2 is a front view of the handle assembly of FIG. 1 showing an exerciser grasping the handle for a biceps curl exercise.
Figure 3:
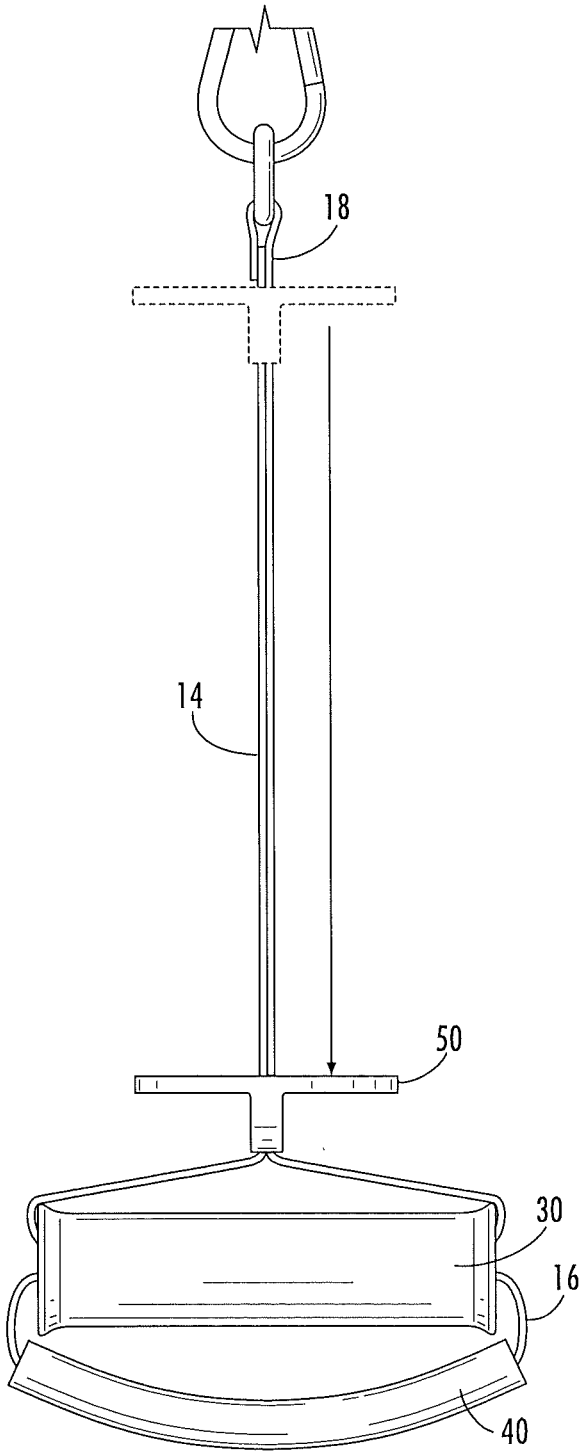
FIG. 3 is a front view of the handle assembly of FIG. 1 with the handle positioned adjacent the cushioning cuff and the bearing member positioned adjacent the handle.
Figure 4:
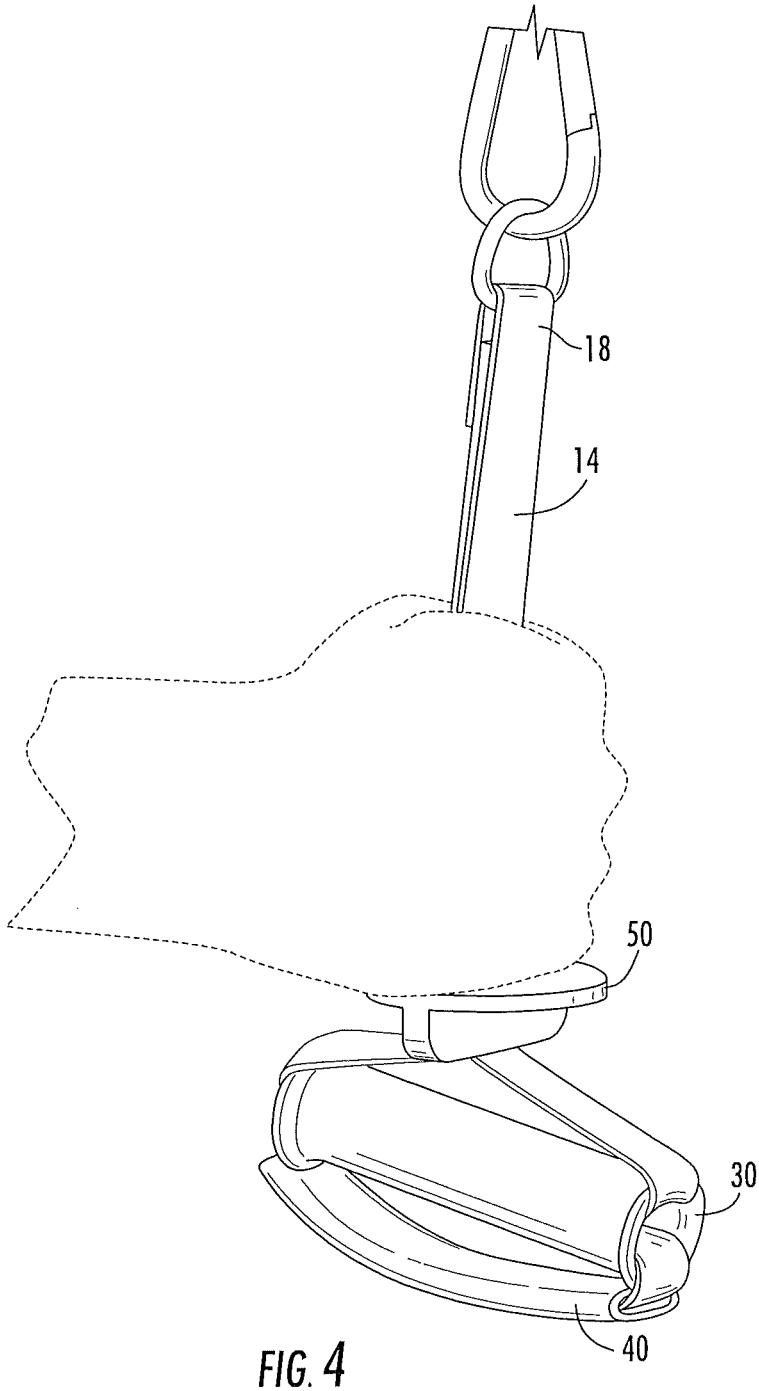
FIG. 4 is a perspective view of the handle assembly as in FIG. 3 showing an exerciser grasping the portions of the near loop and contacting the bearing member for a triceps extension exercise.
Figure 5:
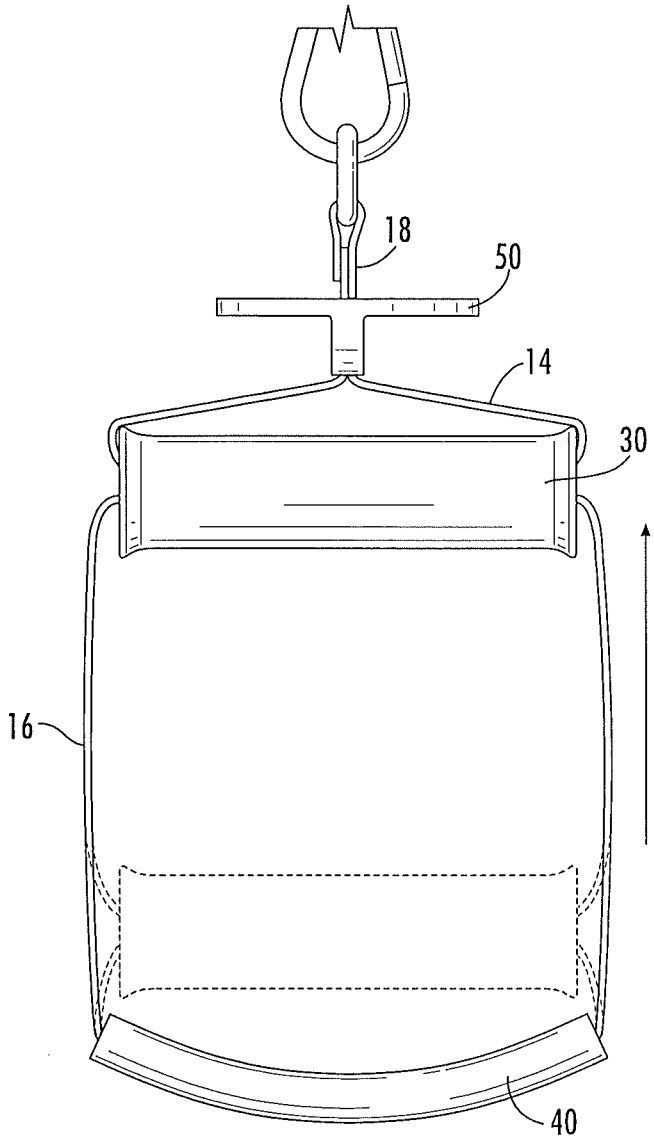
FIG. 5 is a front view of the handle assembly of FIG. 1 with the bearing member positioned adjacent the ring loop and the handle positioned adjacent the bearing member.
Figure 6:
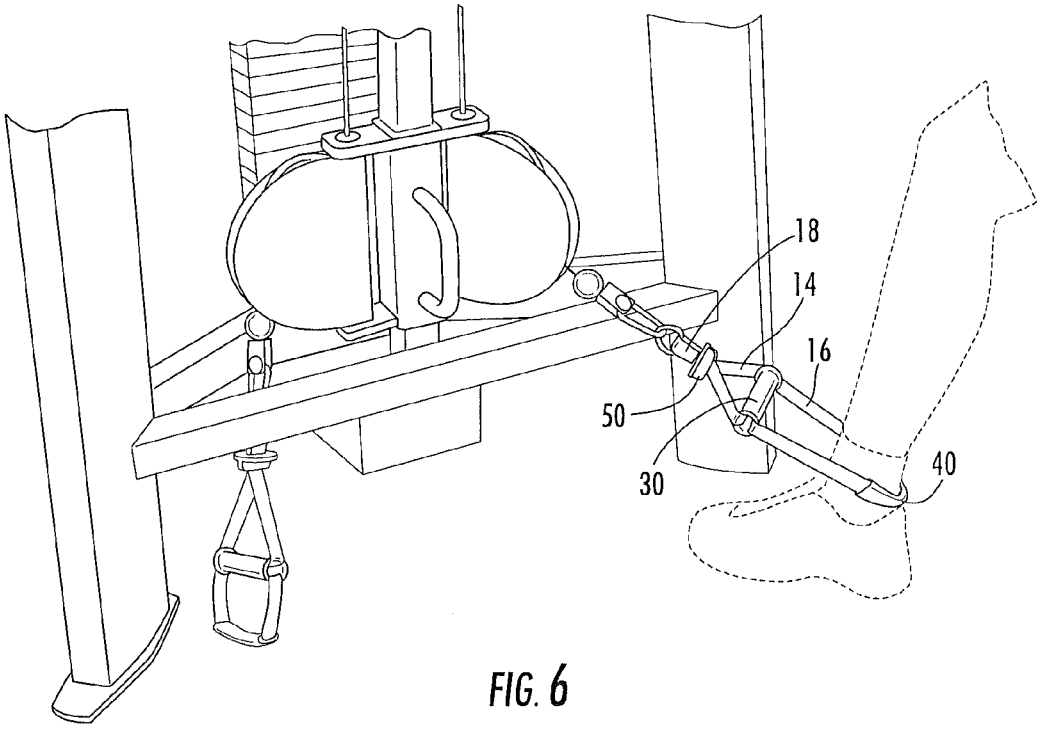
FIG. 6 is a perspective view of the handle assembly as in FIG. 5 showing an exerciser's foot within the far loop for a leg/hip exercise.

The handle 30 is generally cylindrical and defines a hollow tube within an internal cavity or bore 32 (see FIG. 2). The handle 30 is typically formed of a relatively rigid polymeric material, such as nylon, and may include a coating that improves the hand grip of an exerciser. The handle 30 is typically between about 0.75 and 1.25 inches in diameter and 4 to 7 inches in length.

Figure 8:
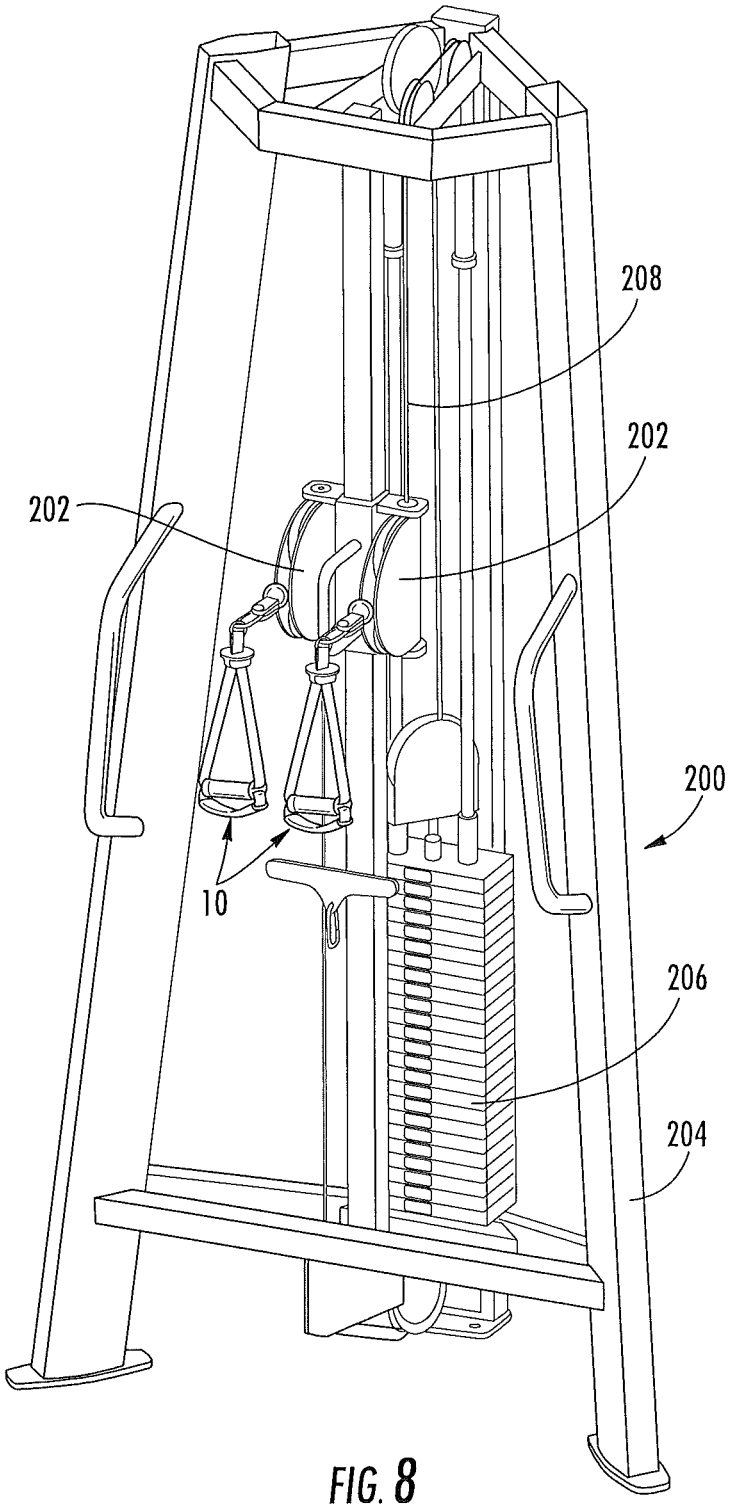
FIG. 8 is a front perspective view of another multi-function exercise machine with two handle assemblies of FIG. 1 attached to cables of the exercise machine.

The strap 12 defines a continuous member in a Figure-8 arrangement. As such, the strap 12 defines a near loop 14 (wherein "near" refers to the distance from the exercise machine) and a far loop 16. The intersection at which the near loop 14 and the far loop 16 meet (i.e., where the strap 12 crosses itself to form a Figure-8) is located within the cavity of the handle 30. A ring bight 18 merges with the near loop 14 at its near end; the ring bight 18 is separated (typically via a sewn seam) from the remainder of the near loop 14, thereby providing an increased thickness to this portion of the strap 12. An attachment ring 20 is received in the ring loop 18 and is configured for attachment to a cable of an exercise machine or the like. The far loop 16 extends away from the handle 30 (i.e., to the side away from the exercise machine).

The Figure-8 configuration of the strap 12 and the positioning of the handle 30 allows the handle 30 to slide toward and away from the ring bight 18. As such, the relative sizes of the near loop 14 and the far loop 16 increase and decrease as the handle 30 is moved toward and away from the ring bight 18.

The cushioning cuff 40 receives the far loop 16 opposite the handle 30. The cushioning cuff 40 is typically flexible (for example, formed of cloth or leather) and may include some degree of cushioning for the comfort of the exerciser. In some embodiments the cushioning cuff 40 is sewn to the far loop 16 to maintain it in position thereon, or it may be free to slide on the far loop 16.

The bearing member 50 is typically a rigid member and may comprise a round disk. The bearing member 50 includes a slot 52. The sides of the near loop 14 are received within the slot 52, such that the bearing member 50 is free to slide between the handle 30 and the ring bight 18.

Operation of the handle assembly 10 can be best understood by reference to FIGS. 1-6. When the handle 10 is to be used for an upper body exercise such as a biceps curl, the handle 30 is drawn away from the ring bight 18 toward the cushioning cuff 40, such that the near loop 14 is large and the far loop 16 is small, and the bearing member 50 is slid on the portions of the strap 12 that form the near loop 14 toward the ring bight 18 (see FIG. 1). As a result, an exerciser can easily grasp the handle 30 (and, in some instances, the cushioning cuff 40) with the palm of his hand, with his fingers being positioned within the near loop 14. The exerciser can this pull the handle assembly 10 toward himself during a biceps curl (see FIG. 2) or another upper body exercise in which the handle is grasped in the palm of the hand.

When the handle assembly 10 is to be used for a leg/hip exercise, the handle 30 is drawn toward the ring bight 18, such that the near loop 14 is small and the far loop 16 is large. The bearing member 50 is slid on the portions of the strap 12 that form the near loop 14 to a position adjacent the ring bight 18 (see FIG. 5). The exerciser can then place his foot through the far loop 16 and position the cushioning cuff 40 against his ankle (see FIG. 6). From this position, the exerciser can draw the handle assembly 10 away from the exercise machine with his ankle during a leg/hip exercise.

When the handle assembly 10 is to be used for a triceps extension exercise, the handle 30 is drawn away from the ring bight 18 toward the cushioning cuff 40, as is done in preparation for a biceps curl exercise. However, for a triceps extension exercise the bearing member 50 is slid on the portions of the strap 12 that form the near loop 14 toward the handle 30 (see FIG. 3). The exerciser can then position the heel of his hand against the near surface of the bearing member 50 and grasp the portions of the strap 12 that form the near loop 14. From this position, the exerciser can force the heel of his against the bearing member 50 to draw the handle assembly 10 away from the exercise machine to perform a triceps extension exercise (see FIG. 4).

Those skilled in this art will recognize that the handle assembly 10 may take different configurations. For example, the bearing member 50 may be square, triangular, or any other shape, and may be of varying thickness. The handle 30 may include surface features, such as finger holds, may be coated to improve the exerciser's grip, or may have a non-round profile. The cushioning cuff 40 may be attached to the strap 12 or may be able to slide relative thereto, and may completely or partially encircle the strap 12. The thickness of the strap 12 may vary. Means other than a ring bight 18 and ring 20 may be employed for attaching the handle assembly to an exercise machine. Other variations will be apparent to those of skill in this art.

Figure 7:
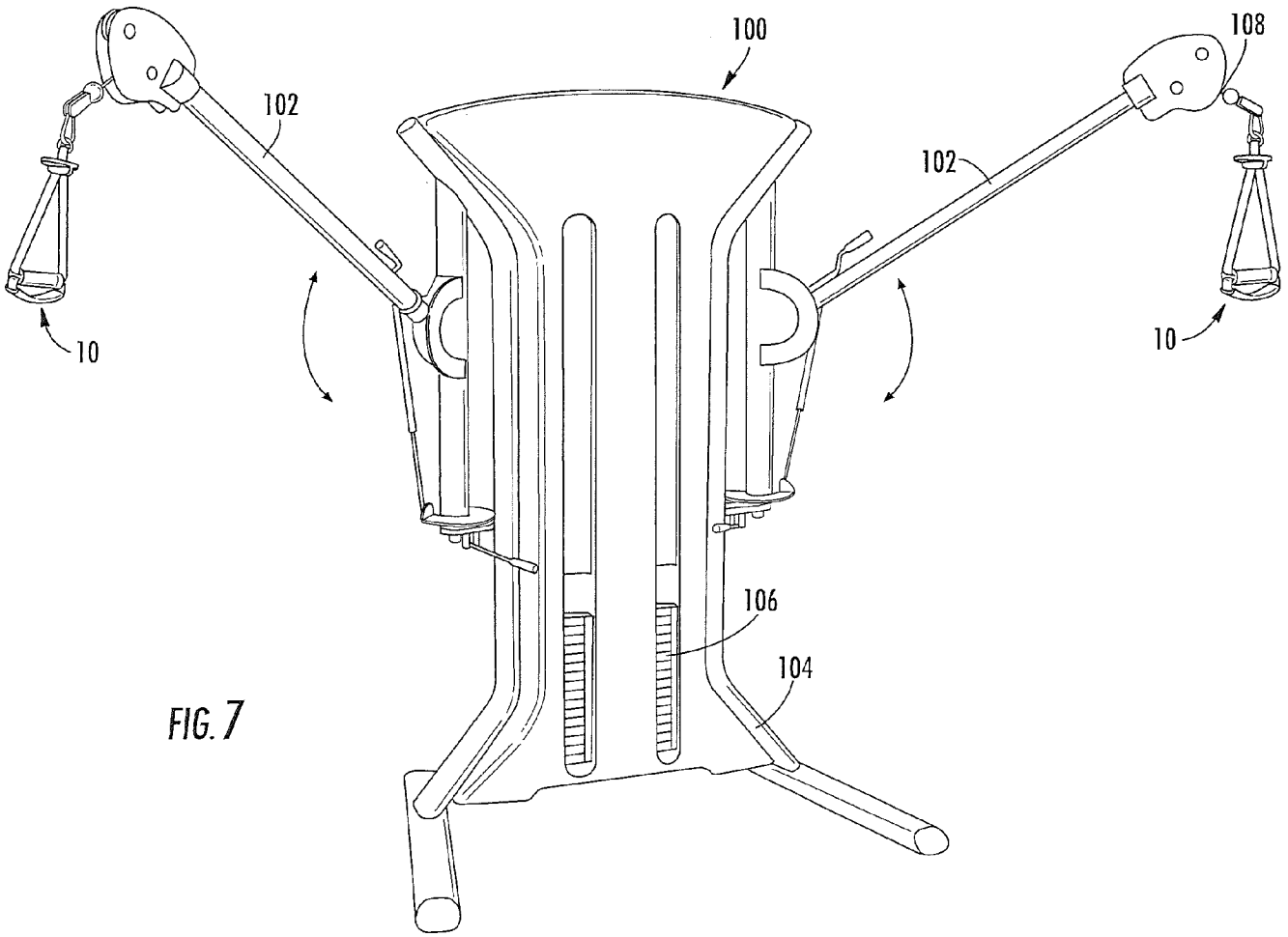
FIG. 7 is a front perspective view of a multi-function exercise machine with two handle assemblies of FIG. 1 attached to cables of the exercise machine.

Also, the handle assembly 10 may be employed with a number of different exercise machines. A multi-function exercise machine 100 is shown in FIG. 7 with two handle assemblies 10 attached. The arms 102 of the machine 100 are attached to a frame 104 and can pivot to different positions, thereby enabling the handle assemblies 100 to be positioned at the appropriate height for arm or leg/hip exercises. Weights 106 or other resistance means are attached to a cable 108, which is attached at its ends to the handle assemblies 10. Movement of the handle assemblies 10 away from the arms 102 raises the weights 106 via the cable 108. Similarly, a machine 200 of a different configuration is shown in FIG. 8 and includes two carriages 202 that can be raised/lowered relative to a frame 204 to position the handle assemblies 10 suitably for a desired exercise. The handle assemblies 10 are attached via a cable 208 to the weights 206.

Although the handle assembly 10 is described in use with a multi-functional exercise machine, it may also be employed with a single function machine. The exercise machine may utilize weights for resistance, or may utilize another component, such as friction-induced resistance. Other variations will be apparent to those of skill in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

That which is claimed is:

1. A multi-functional handle assembly for an exercise machine, comprising:

a strap arranged in a Figure-8 configuration to form a near loop and a far loop extending in generally opposite directions from a crossing point in the strap;

a handle having a cavity formed therethrough, wherein the near loop extends to the near side of the handle and the far loop extends from the far side of the handle, the crossing point of the strap positioned in the cavity;

a cushioning cuff attached to the far loop;

a bearing member having a slot and a planar upper surface configured to receive the heel of a user's hand during a triceps extension exercise, wherein portions of the near loop are threaded through the slot, such that the bearing member is slidable relative to the portions of the near loop; and means for attaching the handle assembly to the exercise machine, the means for attaching the handle assembly being attached to the near loop;

wherein the handle can be drawn between the bearing member and the cushioning cuff, the strap sliding within the handle, such that the near loop and the far loop change in size with sliding of the handle wherein movement of the handle to a position adjacent the cushioning cuff and movement of the bearing member adjacent the means for attaching the handle assembly provides a configuration used to perform upper body exercise in which the handle is grasped in the palm of the hand, movement of the handle to a position adjacent the cushioning cuff and movement of the bearing member to a position adjacent the handle provides a configuration used to perform triceps extension exercise, and movement of the bearing member adjacent the means for attaching the handle assembly and positioning the handle adjacent the bearing member provides a configuration used to perform leg/hip exercises.

2. The handle assembly defined in claim 1, wherein the means for attaching the handle assembly comprises a ring bight attached to the near loop and a ring received in the ring bight.

3. The handle assembly defined in claim 2, wherein the ring bight is contiguous with the strap.

4. The handle assembly defined in claim 1, wherein the bearing member comprises a flat disc.

5. The handle assembly defined in claim 1, wherein the handle comprises a rigid sleeve.

6. The handle assembly defined in claim 1, wherein the cushioning cuff is fixed relative to the far loop.

7. The handle assembly defined in claim 1, attached to a cable of an exercise machine.

8. An exercise machine, comprising:

a frame;

resistance means associated with the frame;

a first movable member attached to the frame;

a first cable attached to the resistance means and associated with the movable member;

a handle assembly attached to one end of the cable, the handle assembly comprising:

a strap arranged in a Figure-8 configuration to form a near loop and a far loop extending in generally opposite directions from a crossing point in the strap;

a handle having a cavity formed therethrough, wherein the near loop extends to a near side of the handle and the far loop extends from a far side of the handle, the crossing point of the strap positioned in the cavity;

a cushioning cuff attached to the far loop;

a bearing member having a slot and a planar upper surface configured to receive the heel of a user's hand during a triceps extension exercise, wherein portions of the near loop are threaded through the slot, such that the bearing member is slidable relative to the portions of the near loop; and means for attaching the handle assembly to the first cable, the means for attaching the handle assembly being attached to the near loop;

wherein the handle can be drawn between the bearing member and the cushioning cuff, the strap sliding within the handle, such that the near loop and the far loop change in size with sliding of the handle; and wherein a) movement of the handle to a position adjacent the cushioning cuff and movement of the bearing member adjacent the means for attaching the handle assembly provides a configuration used to perform an upper body exercise in which the handle is grasped in the palm of the hand of the user and in which the near loop has a first size and the far loop has a first size and, b) movement of the handle to a position adjacent the cushioning cuff and movement of the bearing member to a position adjacent the handle provides a configuration used to perform a triceps extension exercise in which the bearing member is contacted by the heel of the user's hand with a force applied against the bearing member by the heel of the user's hand and in which the near loop has a second size that is smaller than the first size of the near loop and the far loop has the first size, and c) movement of the bearing member adjacent the means for attaching the handle assembly and positioning the handle adjacent the bearing member provides a configuration used to perform a leg/hip exercises and in which the near loop has the second size and the far loop has a second size that is larger than the first size of the far loop.

9. The exercise machine defined in claim 8, wherein the means for attaching the handle assembly comprises a ring bight attached to the near loop and a ring received in the ring bight.

10. The exercise machine defined in claim 9, wherein the ring bight is contiguous with the strap.

11. The exercise machine defined in claim 8, wherein the bearing member comprises a flat disc.

12. The exercise machine defined in claim 8, wherein the handle comprises a rigid sleeve.

13. The exercise machine defined in claim 8, wherein the cushioning cuff is fixed relative to the far loop.

14. The exercise machine defined in claim 8, further comprising: a second movable member attached to the frame and a second cable associated with the second movable member and attached to the resistance means; and a second handle assembly substantially identical to the first handle assembly attached to the second cable.

15. The exercise machine defined in claim 8, wherein the first movable member is a pivoting arm.

16. The exercise machine defined in claim 8, wherein the first movable member is a slidable carriage.

17. A method of exercising with an exercise machine, the method comprising:

(a) providing an exercise machine having:

a frame;

resistance means associated with the frame;

a first movable member attached to the frame;

a first cable attached to the resistance means and associated with the movable member;

a handle assembly attached to one end of the cable, the handle assembly comprising:

a strap arranged in a Figure-8 configuration to form a near loop and a far loop extending in generally opposite directions from a crossing point in the strap;

a handle having a cavity formed therethrough, wherein the near loop extends to a near side of the handle and the far loop extends from a far side of the handle, the crossing point of the strap positioned in the cavity;

a cushioning cuff attached to the far loop;

a bearing member having a slot, wherein portions of the near loop are threaded through the slot, such that the bearing member is slidable relative to the portions of the near loop; and means for attaching the handle assembly to the first cable, the means for attaching the handle assembly being attached to the near loop; wherein the handle can be drawn between the bearing member and the cushioning cuff, the strap sliding within the handle, such that the near loop and the far loop change in size with sliding of the handle;

(b) engaging the handle assembly with a portion of an exerciser's body comprising grasping portions of the near loop with the exerciser's hand as the exerciser contacts the bearing member with the heel of the exerciser's hand as the bearing member is adjacent the handle and the handle is adjacent the cushioning cuff; and (c) drawing the handle assembly away from the frame with a triceps extension exercise by applying a force against the bearing member with the heel of the exerciser's hand.

18. An exercise machine, comprising:

a frame;

resistance means associated with the frame;

a first movable member attached to the frame;

a first cable attached to the resistance means and associated with the movable member;

a handle assembly attached to one end of the cable, the handle assembly comprising:

a strap arranged in a Figure-8 configuration to form a near loop and a far loop extending in generally opposite directions from a crossing point in the strap;

a handle having a cavity formed therethrough, wherein the near loop extends to a near side of the handle and the far loop extends from a far side of the handle, the crossing point of the strap positioned in the cavity;

a cushioning cuff attached to the far loop;

a bearing member having a slot and a planar upper surface configured to receive the heel of a user's hand during a triceps extension exercise, wherein portions of the near loop are threaded through the slot, such that the bearing member is slidable relative to the portions of the near loop; and means for attaching the handle assembly to the first cable, the means for attaching the handle assembly being attached to the near loop;

wherein the handle can be drawn between the bearing member and the cushioning cuff, the strap sliding within the handle, such that the near loop and the far loop change in size with sliding of the handle; and wherein a) movement of the handle to a position adjacent the cushioning cuff and movement of the bearing member adjacent the means for attaching the handle assembly provides a configuration used to perform an upper body exercise in which the handle is grasped in the palm of the hand of the user, b) movement of the handle to a position adjacent the cushioning cuff and movement of the bearing member to a position adjacent the handle provides a configuration used to perform a triceps extension exercise in which the bearing member is contacted by the heel of the user's hand with a force applied against the bearing member by the heel of the user's hand, and c) movement of the bearing member adjacent the means for attaching the handle assembly and positioning the handle adjacent the bearing member provides a configuration used to perform a leg/hip exercises.

* * * * *